US005584135A

United States Patent [19]

Hosker

[11] Patent Number: 5,584,135

[45] Date of Patent: Dec. 17, 1996

[54] PERSONALIZED CUSTOM EMBLEM-SECURE AWARD

[76] Inventor: Thomas M. Hosker, 17 Dona St., Lynn, Mass. 01904

[21] Appl. No.: 452,316

[22] Filed: May 26, 1995

[51] Int. Cl.[6] ..... B44C 5/04

[52] U.S. Cl. ..... 40/800; 40/768

[58] Field of Search ..... 40/160, 152, 152.1, 40/154, 156

[56] References Cited

PUBLICATIONS

Hook–Fast Specialties, Inc. Fire Catalog, Copyright 1993 Front cover, p. 2, and p. 63, Providence, R.I.

*Primary Examiner*—Joanne Silbermann
*Attorney, Agent, or Firm*—Kenway & Crowley

[57] ABSTRACT

An award plaque including a picture display assembly, on the top surface of which organizational and individual identifying data may be disposed and a securely retained three-dimensional emblem may be mounted. The mounting of the emblem fixes the emblem in place on the plaque and is hidden from view and inaccessible after the plaque is completely assembled to prevent loss or casual pilferage of the emblem. On the bottom surface of the plaque, a wall hanger and easel stand are provided.

1 Claim, 1 Drawing Sheet

PERSONALIZED CUSTOM EMBLEM-SECURE AWARD

BACKGROUND OF THE INVENTION

This invention relates in general to awards of the type presented to individuals upon the achievement of a notable career milestone or as recognition of the accomplishment of a meritorious deed. Most commonly, such awards are presented on the occasion of a service anniversary or the retirement of an individual. Frequently, it is the practice to indicate on the award years of service and, of course, to identify the individual as well as the organization in which the service was performed. Awards are usually made of a base of polished wood or other attractive material on which nameplates bearing the names of the organization and the individual recipient are mounted. Also, an emblem in the form of a badge or other insignia of the type worn by the individual during his years of service may also be attached to the base. Such plaques, while usually gratefully received and later proudly displayed by the recipient, are satisfactory in most respects, but lack a certain desired tone of personal warmth. Also, there is a tendency for the badge or other three-dimensional emblem to become detached accidentally or even deliberately from the plaque base and lost. Accidental detachment results from the fact that the wood of the base as it ages sometimes dries out and the relatively heavy badge is forced from its position because of the different rates of expansion of the badge material and the material of the base. Deliberate detachment occurs, of course, because the badges or emblems constitute tempting souvenirs or, in the case of some badges, potentially criminally useful insignia.

SUMMARY OF THE INVENTION

Basically, the invention is concerned with a peripherally frame-locked sandwiched assembly of panels. The top panel member is formed with at least one relatively large opening to accept and frame a photograph. Also on the front surface of the top member there may be decoratively printed the names of the organization and the individual involved in the presentation of the award. Alternatively, there may be provided mounts to receive polished brass plates on which the names of the organization and the individual recipient may be suitably engraved. Finally, provision is made to mount a badge or other relatively heavy three-dimensional emblem of office securely on the plaque.

The general object of the present invention is to provide a plaque which is relatively inexpensive yet elegantly executed with a personal component.

Another object of the present invention is to protect against the loss or removal of emblems from award plaques.

Still another object of the present invention is to provide a pictorial reminder of the occasion of the presentation of the award plaque.

For a better understanding of the present invention, together with other and further objects, features, and advantages, reference should be made to the following specification of a specific embodiment of the invention in which:

DESCRIPTION OF PREFERRED EMBODIMENT

Figure 1:
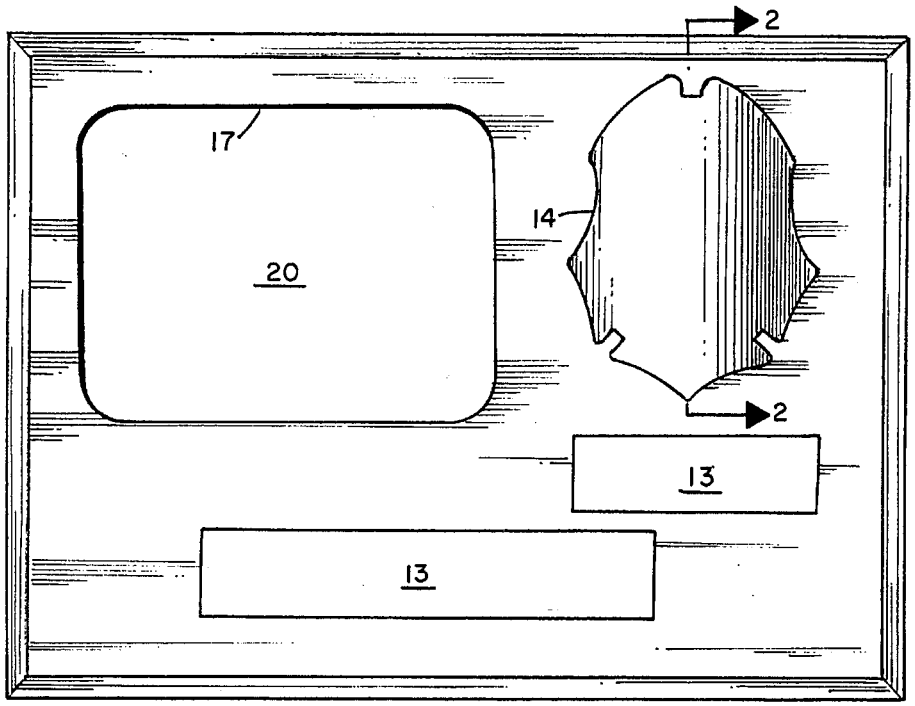
FIG. 1 is a front view of a typical award plaque made in accordance with the present invention and ready for insertion of a current photographic print.

In FIG. 1, there may be seen an award plaque made in accordance with the present invention which includes a top panel 12 which may be made from pasted paper board or chipboard laminated with a decorative paper or plastic. The top panel 12 desirably carries the name of an organization, in this case Police Department, Texarkana, Ark. The organization name would of course be common to a number of such awards and for decorative purposes might be composed of hot foil stamping on the decorative surface of the top panel 12 or a brass plate mounted on the surface. The top panel 12 also includes mounting means (not visible in this view) designed to hold, for example, another brass nameplate 13 on which an individual's name may be inscribed.

Also formed through the top panel is a relatively large, generally rectangular opening 17 through which a photographic print may be inserted and manipulated into position such that it is framed by the top panel in a manner described hereinbelow. The corners of the opening may be rounded to facilitate picture insertion and to improve the appearance of the frame.

Mounted on the top panel is a badge 14 carrying suitable insignia and identification with the organization with which it is associated. The badge may either be the actual badge worn by the recipient of the award or a replica. In either case, it is relatively heavy and of substantial thickness and weight relative to the other elements of the award. Detail on the mounting of the badge on the top panel is given hereinbelow.

Surrounding the award is a peripheral frame 28 made of light metal material of U-shaped cross-section. The top panel and associated underpanels are held in a sandwiched relationship in the enclosing U-shaped walls of the frame.

Figure 2:
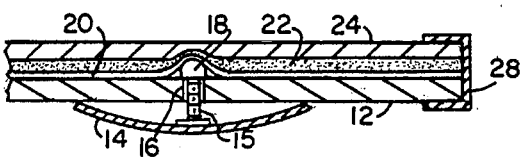
FIG. 2 is a sectional view of a portion of FIG. 1 taken along the lines 2—2.

In the sectional view of FIG. 2, there may be seen the top panel 12 on which the emblem or badge 14 is mounted. The badge 14 has an integral threaded stud 15 protruding from its underside, the stud 15 passing through a relatively small opening 16 formed in the top panel 12. A nut 18 which may have a knurled periphery to facilitate hand-tightening of the nut 18 to lock the badge or emblem in place is threaded onto the stud 15. The top panel is relatively stiff and inflexible material, the decorative top surface of which may have, for example, an embossed grained appearance. Also, as noted above, the top panel is formed with the relatively large rectangular opening 17 for the insertion of a picture which may be of the type of instant print made and sold under the trademark Polaroid by the company of that name. Other photographic prints of suitable size may also be used, but the instant type is preferred because of the immediacy of its time relationship to the presentation of the award.

Figure 3:
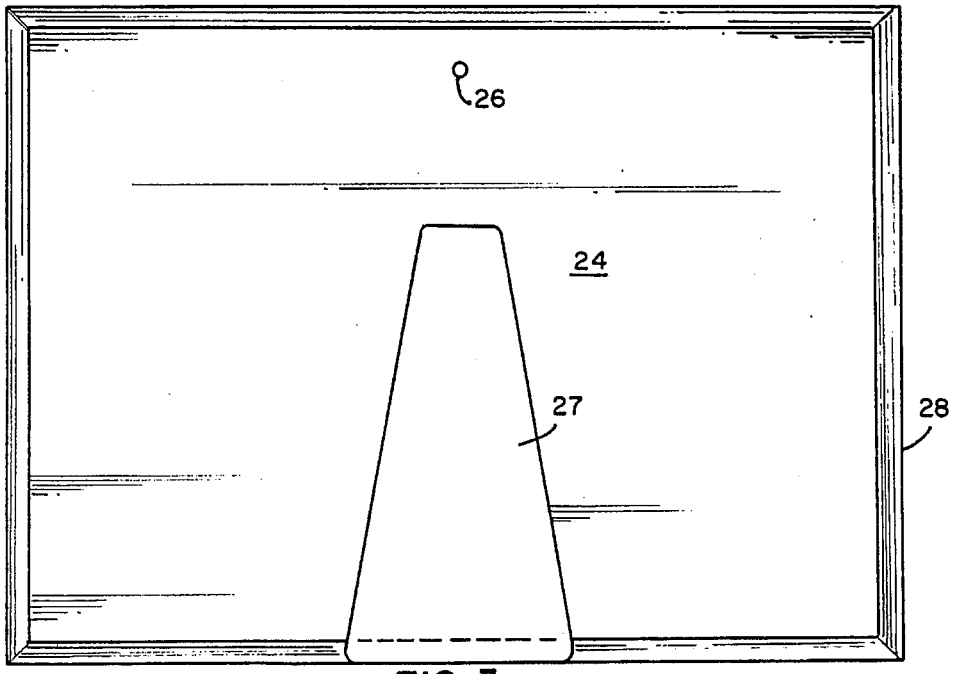
FIG. 3 is a rear view of the award plaque, showing mounting and hanging elements.

Beneath the top panel 12 is a backing panel 20 similar in area to the top panel and maintained in relatively close resilient contact with the underside of the top panel. The backing panel 20 is also of relatively stiff material such as bleached manilla and is urged against the underside of the top panel by a resilient layer 22. The resilient layer 22 is of the same general area but preferably somewhat thicker than the top panel and the backing panel, and may be made of material such as polyurethane foam. Finally, there is provided a bottom member 24 of relatively heavy inflexible material which may have a decorative outer lower surface similar to that of the outer top surface panel 12. Attached to the outer surface of the bottom member near the top center is a hanger in the shape of a ring or eyelet 26 which is firmly affixed to the member 24. In its preferred form, the hanger is a ring which normally lies flat against the bottom member but which pivots out from the bottom member to accommodate a picture hook or other wall fastener. FIG. 3 illustrates the outer surface of the bottom panel of the assembly. Also attached to the outer surface of the bottom member is a pivoted erectable easel stand member 27 which permits the assembly to be placed free-standing on a suitable surface for viewing.

In U.S. Pat. No. 4,117,613, the subject matter of which was also invented and is owned by the applicant in this case, somewhat similar structure relating to picture loading and display is disclosed. Relevant disclosure in that patent is incorporated herein by reference.

In the assembly of the present invention, similar to one alternative of the cited patent, there is a locking peripheral frame 28. The frame is composed of a length of material of U-shaped cross-section within which the edges of the assembly of panels are sandwiched. The frame is prepared to be bent into a rectangle by cutting triangular sections in the walls of the U-shaped material at suitably spaced points. The ends of the length of material may be joined to complete the rectangle by inserting a tongue at one end into a slotted opening in the cooperating opposite end of the length of material. A tang may be formed in the bottom wall of the U-shaped member to maintain the tongue in the one end in the slotted opening in the other end of the material when the ends are forced together. Such closures are known in the art and are not deemed to be a part of the present invention.

The various panels are assembled and locked in sandwiched relationship by the enclosing peripheral frame after the badge or emblem is securely fixed in place by the flanged nut bearing upon the undersurface of the top panel member 12. The stud 15 butts against the backing panel 20 and is covered by that panel, the resilient layer 22, and the bottom panel 24. The flanged nut 18 is hidden from view and inaccessible, which substantially prevents removal of the badge or emblem without completely dismantling the entire assembly. Because there is no access to the flanged mounting nut 18, loss or casual pilfering of the badge or emblem is discouraged, thereby lending an air of security to the award.

What is claimed is:

1. In an award plaque, the combination of a picture display assembly of personal and organizational identifications and a secure base mount for a three-dimensional emblem, said picture display assembly having a relatively stiff, inflexible top panel and a backing panel also of relatively stiff material disposed against the underside of said top panel, a resilient layer coextensive in area with and disposed beneath said backing panel, said top panel having at least a relatively large opening formed therethrough for the insertion of a picture, a nameplate being mounted on said top panel in proximity to said relatively large opening, an organizational identifier also disposed on said top panel in proximity to said relatively large opening, a three-dimensional emblem having insignia formed on the front face thereof, an attachment member including a threaded stud integral with and extending from the back face of said emblem, said top panel having a relatively small opening formed therethrough to accommodate said stud and a nut threaded on said stud and bearing on the underside of said top panel to attach said emblem in place on said top panel, a bottom panel disposed beneath said resilient layer, and a perimeter frame member locking said top panel, said backing panel, said resilient layer, and said bottom panel in a sandwiched assembly enclosing and concealing said attachment member from view.

* * * * *